US010030404B2

(12) United States Patent
Aujaghian

(10) Patent No.: US 10,030,404 B2
(45) **Date of Patent: *Jul. 24, 2018**

(54) SLIDING SEISMIC ISOLATOR

(71) Applicant: Damir Aujaghian, Newport Beach, CA (US)

(72) Inventor: Damir Aujaghian, Newport Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/386,826

(22) Filed: Dec. 21, 2016

(65) Prior Publication Data

US 2017/0167155 A1 Jun. 15, 2017

Related U.S. Application Data

(63) Continuation of application No. 14/155,169, filed on Jan. 14, 2014, now Pat. No. 9,534,379.

(60) Provisional application No. 61/752,363, filed on Jan. 14, 2013.

(51) Int. Cl.
*E04H 9/02* (2006.01)
*E04B 1/98* (2006.01)

(52) U.S. Cl.
CPC ..... *E04H 9/021* (2013.01); *E04B 1/985* (2013.01)

(58) Field of Classification Search
CPC ..... E02D 27/34; E04B 1/985; E04H 9/021; E04H 9/022
USPC ..... 52/167.1, 167.2, 167.4–167.7, 168.8, 52/167.9
See application file for complete search history.

(56) References Cited

U.S. PATENT DOCUMENTS

| | | | |
|---|---|---|---|
| 3,638,377 | A | 2/1972 | Caspe |
| 4,978,581 | A | 12/1990 | Fukahori et al. |
| 5,238,082 | A | 8/1993 | Stegman et al. |
| 5,456,047 | A | 10/1995 | Dorka |
| 5,761,856 | A | 6/1998 | Kishizono |
| 5,848,660 | A | 12/1998 | McGreen |
| 6,138,967 | A | 10/2000 | Okamoto |
| 6,385,918 | B1 | 5/2002 | Robinson |

(Continued)

FOREIGN PATENT DOCUMENTS

| | | |
|---|---|---|
| RU | 1794143 A3 | 2/1993 |
| RU | 46517 U1 | 7/2005 |

(Continued)

OTHER PUBLICATIONS

PCT Search Report and Written Opinion for PCT/US2014/011512, dated May 15, 2014, in 22 pages.

*Primary Examiner* — William V Gilbert
(74) *Attorney, Agent, or Firm* — Knobbe Martens Olson & Bear, LLP

(57) ABSTRACT

A sliding seismic isolator includes a first plate attached to a building support, and an elongate element extending from the first plate. The seismic isolator also includes a second plate and a low-friction layer positioned between the first and second plates, the low-friction layer allowing the first and second plates to move freely relative to one another along a horizontal plane. The seismic isolator also includes a lower support member attached to the second plate, with a biasing arrangement, such as at least one spring member or at least one engineered elastomeric element, which can include one or more silicon inserts, positioned within the lower support member. The elongate element extends from the first plate at least partially into the lower support member and movement of the elongate element is influenced or controlled by the biasing arrangement.

23 Claims, 7 Drawing Sheets

(56) References Cited

U.S. PATENT DOCUMENTS

| | | | |
|---|---|---|---|
| 8,844,205 | B2 | 9/2014 | Michael et al. |
| 9,534,379 | B2 | 1/2017 | Aujaghian |

FOREIGN PATENT DOCUMENTS

| | | | |
|---|---|---|---|
| RU | 101514 | U1 | 1/2011 |
| SU | 1733572 | A1 | 5/1992 |
| WO | WO 2014/110582 | | 7/2014 |

SLIDING SEISMIC ISOLATOR

INCORPORATION BY REFERENCE TO RELATED APPLICATIONS

Any and all applications identified in a priority claim in the Application Data Sheet, or any correction thereto, are hereby incorporated by reference herein and made a part of the present disclosure.

BACKGROUND

Field

The present application is directed generally toward seismic isolators, and specifically toward seismic isolators for use in conjunction with buildings to inhibit damage to the buildings in the event of an earthquake.

Description of Related Art

Seismic isolators are commonly used in areas of the world where the likelihood of an earthquake is high. Seismic isolators typically comprise a structure or structures that are located beneath a building, underneath a building support, and/or in or around the foundation of the building.

Seismic isolators are designed to minimize the amount of load and force that is directly applied to the building during the event of an earthquake, and to prevent damage to the building. Many seismic isolators incorporate a dual plate design, wherein a first plate is attached to the bottom of a building support, and a second plate is attached to the building's foundation. Between the plates are layers of rubber, for example, which allow side-to-side, swaying movement of the plates relative to one another. Other types of seismic isolators for example incorporate a roller or rollers built beneath the building, which facilitate movement of the building during an earthquake. The rollers are arranged in a pendulum-like manner, such that as the building moves over the rollers, the building shifts vertically at first until it eventually settles back in place.

SUMMARY

An aspect of at least one of the embodiments disclosed herein includes the realization that current seismic isolators fail to provide a smooth, horizontal movement of the building relative to the ground during an earthquake. As described above, current isolators permit some horizontal movement, but the movement is accompanied by substantial vertical shifting or jarring of the building, and/or a swaying effect that causes the building to tilt from side to side as it moves horizontally. Such movement can cause unwanted damage or stress on the building. Additionally, current isolators often require the procedure of vulcanizing rubber to metal, which can be expensive. Additionally, the rubber in current isolators can lose its strain capacity over time. Furthermore, current isolators often do not work well with loose soil, as they tend to develop unwanted frequencies. Therefore, it would be advantageous to have a simplified seismic isolator that can more efficiently permit smooth, horizontal movement of a building in any compass direction during an earthquake, avoiding at least one or more of the problems of current isolators described above.

Thus, in accordance with at least one embodiment disclosed herein, a sliding seismic isolator can comprise a first plate configured to be attached to a building support, with an elongated element (or elements) extending from the center of (central portion of, or other suitable locations of) the first plate. The sliding seismic isolator can further comprise a second plate and a low-friction layer positioned between the first and second plates configured to allow the first and second plates to move freely relative to one another along a horizontal plane. The sliding seismic isolator can further comprise a lower support member attached to the second plate, with at least one spring member or perforated elastomeric element positioned within the lower support member; the elongated element or elements extending from the first plate at least partially into the lower support member.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION

For convenience, the embodiments disclosed herein are described in the context of a sliding seismic isolator device for use with commercial or residential buildings, or bridges. However, the embodiments can also be used with other types of buildings or structures where it may be desired to minimize, inhibit, and/or prevent damage to the structure during the event of an earthquake.

Various features associated with different embodiments will be described below. All of the features of each embodiment, individually or together, can be combined with features of other embodiments, which combinations form part of this disclosure. Further, no feature is critical or essential to any embodiment.

Figure 1:
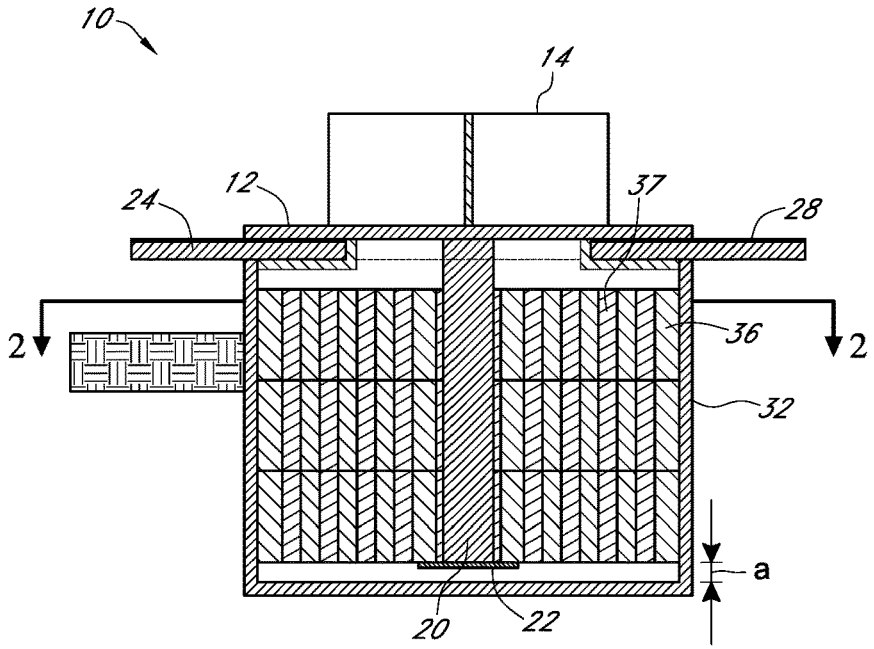
FIG. 1 is a cross-sectional schematic illustration of an embodiment of a sliding seismic isolator attached to a building support.

With reference to FIG. 1, a seismic isolator 10 can comprise a device configured to inhibit damage to a building during the event of an earthquake. The seismic isolator 10 can comprise two or more components that are configured to move relative to one another during the event of an earthquake. For example, the seismic isolator 10 can comprise two or more components that are configured to slide relative to one another generally or substantially along a geometrical plane during an earthquake. The seismic isolator 10 can comprise at least one component that is attached to a building support, and at least another component attached to the building's foundation and/or in or above the ground.

Figure 3:
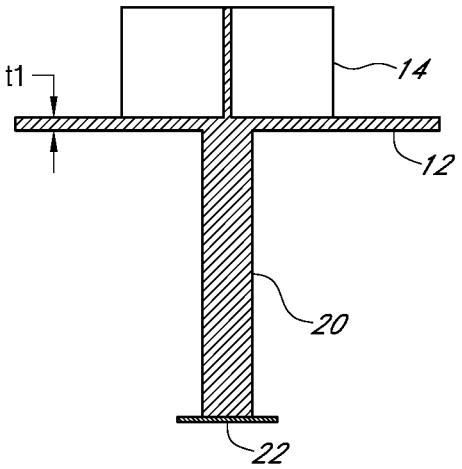
FIG. 3 is a front elevational view of the building support and a portion of the seismic isolator of FIG. 1.
Figure 4:
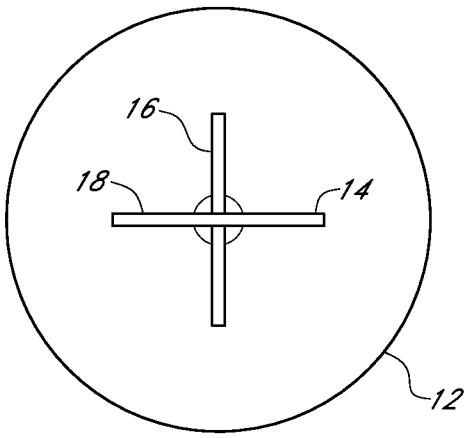
FIG. 4 is a top plan view of the building support and portion shown in FIG. 3.

With reference to FIGS. 1, 3, and 4, for example, a seismic isolator 10 can comprise a first plate 12. The first plate 12 can comprise a circular or an annular shaped plate, although other shapes are also possible (e.g., square.) The first plate 12 can be formed of metal, for example stainless steel, although other materials or combinations of materials are also possible. For example, in some embodiments the second plate 24 can be comprised primarily of metal, but with at least one layer of a plastic or polymer material, such as polytetrafluoroethylene (PTFE), which is sold under the trademark TEFLON®, or other similar materials. The second plate 24 can also have a thickness. The first plate 12 can also have a thickness. In some embodiments the thickness can generally be constant throughout the first plate 12, although varying thicknesses can also be used. In some embodiments the first plate 12 can have a thickness "t1" of approximately ½ inch, although other values are also possible. The thickness "t1" can vary, based on the expected loads.

As seen in FIGS. 3 and 4, the first plate 12 can be attached to or integrally formed with the bottom of a building support 14. The building support 14 can comprise, for example, a cross-shaped support having first and second support components 16, 18, although other types of building supports 14 can also be utilized in conjunction with the first plate 12. The building support 14 can be made of wood, steel, concrete, or other material. The first plate 12 can be attached to the building support 14, for example, by welding the first plate 12 to the bottom of the building support 14, or by using fasteners such as bolts, rivets, or screws, or other known methods. The first plate 12 can be rigidly attached to the building support 14, such that substantially no relative movement occurs between the first plate 12 and the building support 14.

With continued reference to FIGS. 1, 3, and 4, at least one elongate element 20 can extend from the first plate 12. The elongate element 20 can be formed integrally with the first plate 12, or can be attached separately. For example, the elongate element 20 can be bolted or welded to the first plate 12. The elongate element 20 can comprise a cylindrical metal rod, although other shapes are also possible. In some embodiments the elongate element 20 can have a circular cross-section. In some embodiments the elongate element 20 can be a solid steel (or other suitable material) bar. The elongate element 20 can extend from a geometric center of the first plate 12. In some embodiments the elongate element 20 can extend generally perpendicularly relative to a surface of the first plate 12. In some embodiments, multiple elongate elements 20 can extend from the first plate 12. For example, in some embodiments four elongate elements 20 can extend generally from a geometric center of the first plate 12. In some embodiments the multiple elongate elements 20 can flex and/or bend so as to absorb some of the energy from seismic forces during an earthquake. The elongate element 20 can also include a cap 22. The cap 22 can be integrally formed with the remainder of the elongate element 20. The cap 22 can be comprised of the same material as that of the remainder of the elongate element 20, although other materials are also possible. The cap 22 can form a lowermost portion of the elongate element 20.

With reference to FIGS. 1, 2, 5, and 6, the seismic isolator 10 can comprise a second plate 24. The second plate 24 can comprise a circular or an annular shaped plate, although other shapes are also possible (e.g., square.) The second plate 24 can be formed of metal, for example stainless steel, although other materials or combinations of materials are also possible. For example, in some embodiments the second plate 24 can be comprised primarily of metal, with a PTFE (or other similar material) adhered layer. The second plate 24 can also have a thickness. In some embodiments the thickness can generally be constant throughout the second plate 24, although varying thicknesses can also be used. In some embodiments, the second plate 24 can have a thickness "t2" of approximately ½ inch, although other values are also possible. The thickness "t2" can vary, based on the expected loads.

Figure 2:
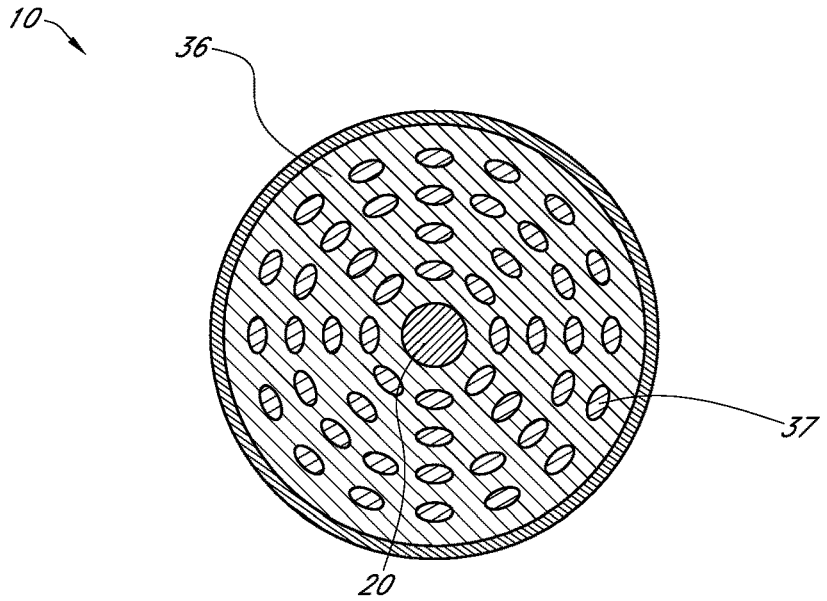
FIG. 2 is a cross-sectional view of the seismic isolator of FIG. 1, taken along line 2-2 in FIG. 1.
Figure 5:
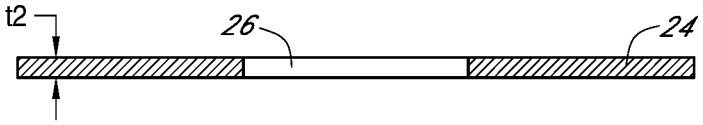
FIG. 5 is a cross-sectional view of a portion of the seismic isolator of FIG. 1.
Figure 6:
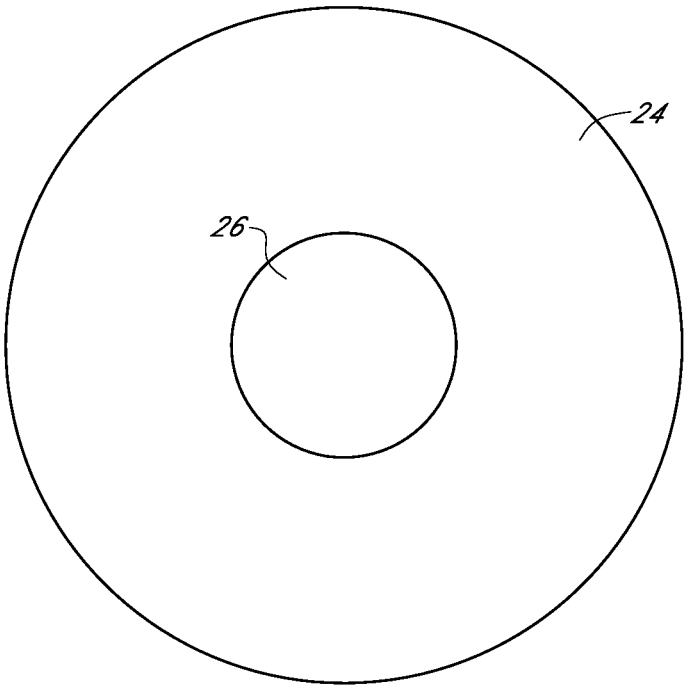
FIG. 6 is a top plan view of the portion shown in FIG. 5.

With reference to FIGS. 5 and 6, the second plate 24 can include an opening 26. The opening 26 can be formed at a geometric center of the second plate 24. With reference to FIGS. 1 and 2, the opening 26 can be configured to receive the elongate element 20. The opening 26 can be configured to accommodate movement of the elongate element 20 and first plate 12 relative to the second plate 24.

Figure 7:
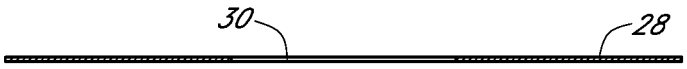
FIG. 7 is a cross-sectional view of a portion of the seismic isolator of FIG. 1.
Figure 8:
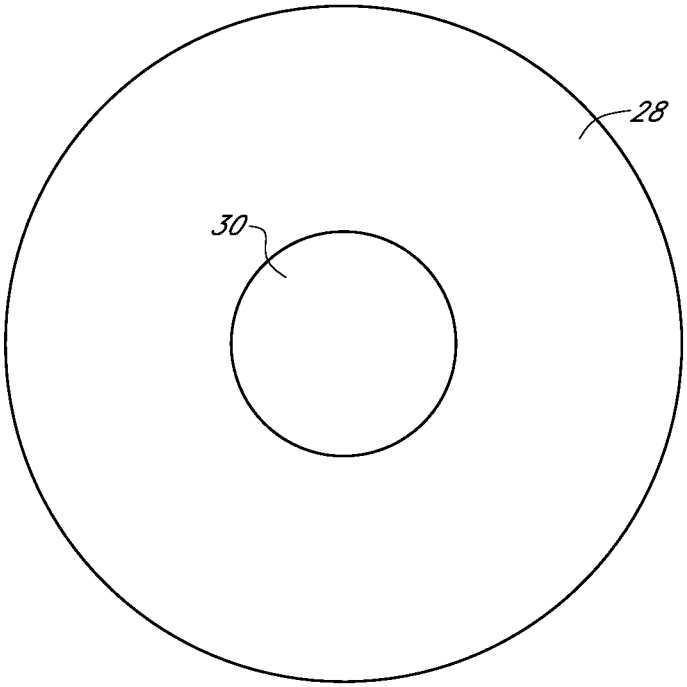
FIG. 8 is a top plan view of the portion shown in FIG. 7.

For example, and with reference to FIGS. 1, 7, and 8, the seismic isolator 10 can comprise a low-friction layer 28. The low-friction layer 28 can comprise, for example, PTFE or other similar materials. The low-friction layer 28 can be in the form of a thin, annular-shaped layer having an opening 30 at its geometric center. Other shapes and configurations for the low-friction layer 28 are also possible. Additionally, while one low-friction layer 28 is illustrated, in some embodiments multiple low-friction layers 28 can be used. In alternative arrangements, the low-friction layer 28 can comprise a movement assisting layer, which could include movement assisting elements (e.g., bearings.)

With continued reference to FIGS. 1, 7 and 8, the low-friction layer 28 can have generally the same profile as that of the second plate 24. For example, the low-friction layer 28 can have the same outer diameter as that of the second plate 24, as well as the same diameter-sized opening in its geometric center as that of second plate 24. In some embodiments the low-friction layer 28 can be formed onto and/or attached to the first plate 12 or second plate 24. For example, the low-friction layer 28 can be glued to the first plate 12 or second plate 24. The low-friction layer 28 can be a layer, for example, that provides a varying frictional resistance between the first and second plates 12 and 24 (as opposed to the normal 100% generated between the two plates). Preferably, the low-friction layer 28 at least provides reduced frictional resistance compared to the material used for the first plate 12 and the second plate 24. For example, as illustrated in FIG. 1, in some embodiments the first plate 12, low-friction layer 28, and second plate 24 can form a sandwiched configuration. Both the first plate 12 and the second plate 24 can be in contact with the low-friction layer 28, with the low-friction layer 28 allowing relative movement of the first plate 12 relative to the second plate 24. The first plate 12 and second plate 24 can thus be independent components of the seismic isolator 10, free to move relative to one another along a generally horizontal plane. In some embodiments the first and second plates 12 and 24 can support at least a portion of the weight of the building.

Figure 9:
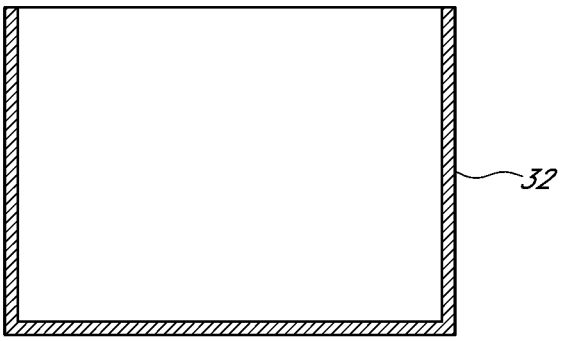
FIG. 9 is a cross-sectional view of a portion of the seismic isolator of FIG. 1.
Figure 10:
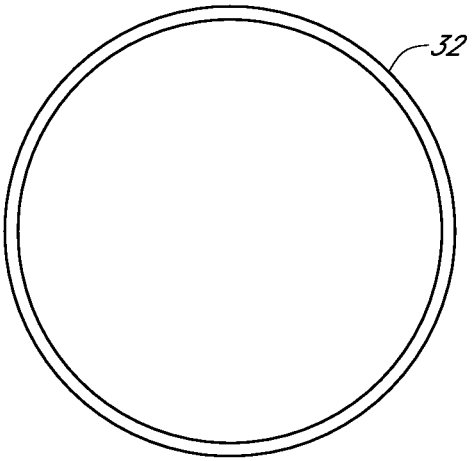
FIG. 10 is a top plan view of the portion shown in FIG. 9.

With reference to FIGS. 1, 9, and 10, the seismic isolator 10 can additionally comprise a lower support element 32. The lower support element 32 can be configured to stabilize the second plate 24 and hold it in place, thereby allowing only the first plate 12 to move relative to the second plate 24. In some embodiments the lower support element 32 can be attached directly to or be formed integrally with the second plate 24. The lower support element 32 can comprise an open cylindrical shell, as shown in FIGS. 9 and 10, although other shapes and configurations are also possible. The lower support element 32 can be buried in a foundation or otherwise attached to a foundation of the building, such that the lower support element generally moves with the foundation during the event of an earthquake.

Figure 11:
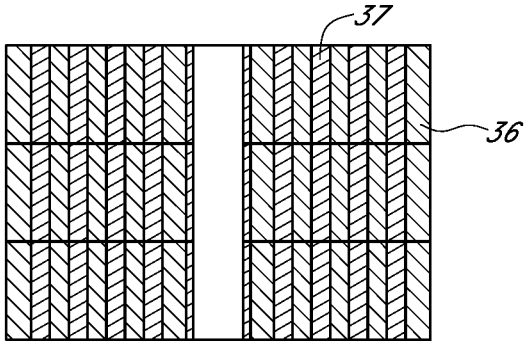
FIG. 11 is a cross-sectional view of a portion of the seismic isolator of FIG. 1.
Figure 12:
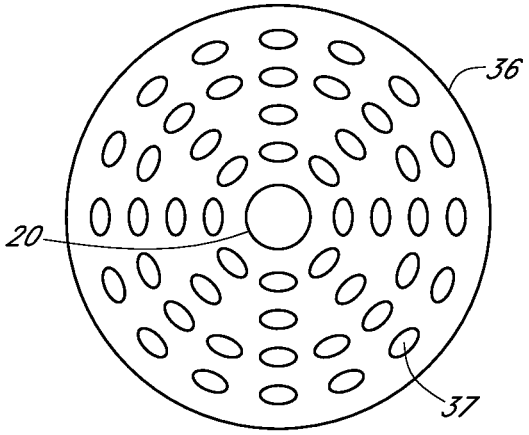
FIG. 12 is a top plan view of the portion shown in FIG. 11.
Figure 13:
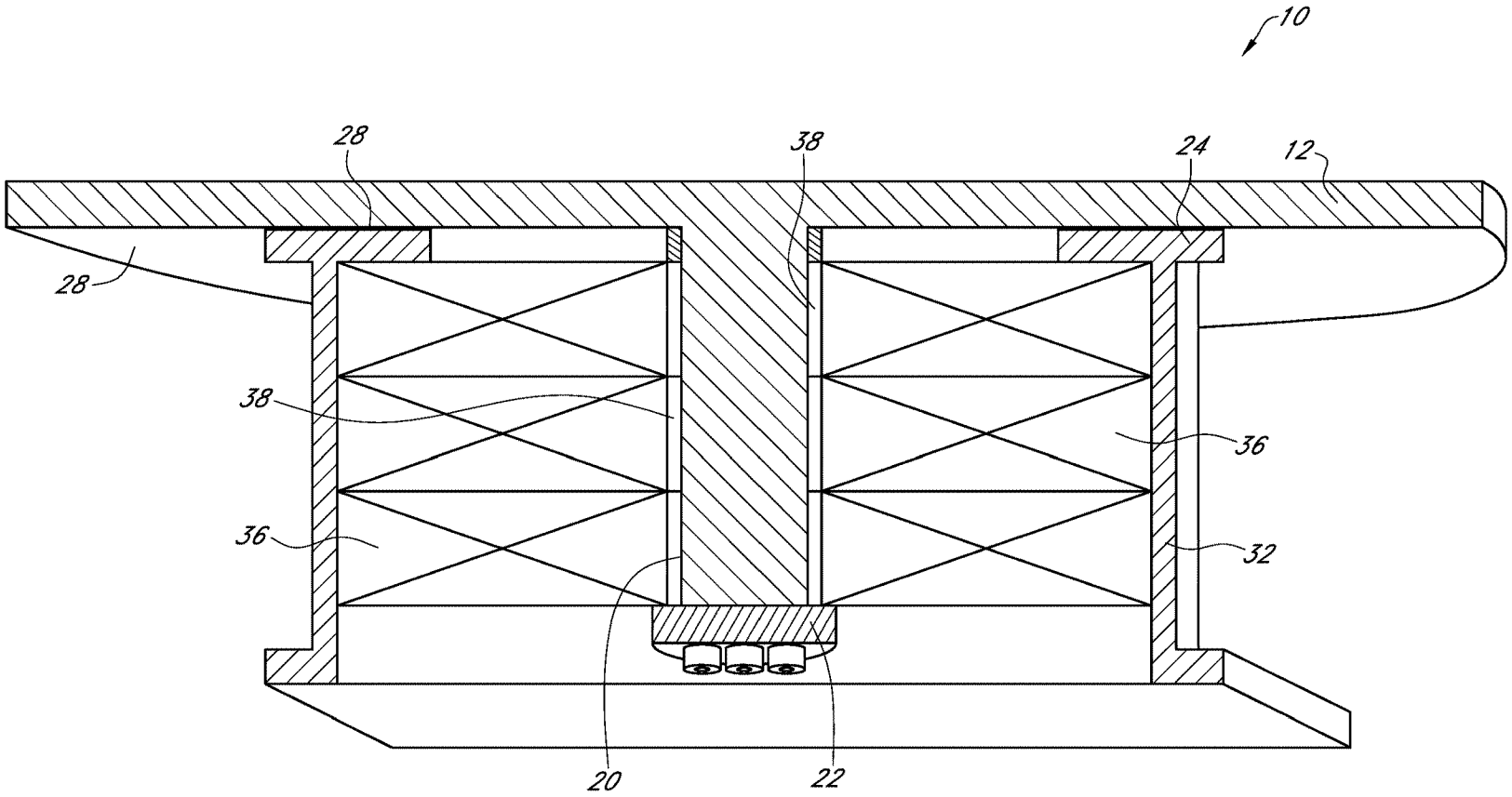
FIG. 13 is a cross-sectional view of a modification of the seismic isolator of FIGS. 1-12.

With reference to FIGS. 1, 2, 11, 12 and 13 the lower support element 32 can be configured to house at least one component that helps guide the elongate element 20 and return the elongate element 20 back toward or to an original resting position after the event of an earthquake. For example, as illustrated in FIGS. 1, 11 and 12, the seismic isolator 10 can comprise at least one biasing element 36, such as a spring component or engineered perforated rubber component. The perforated rubber component 36 can be a single component or multiple components (e.g., a stack of components, as illustrated). Preferably, the perforated rubber component 36 includes voids or perforations 37, which can be filled with a material, such as a liquid or solid material (e.g., silicon). The spring or rubber components 34 can comprise flat metal springs or engineered perforated rubber. The spring and/or rubber components 34 can be housed within the lower support element 32. The number and configuration of the spring and/or rubber components 34 used can depend on the size of the building. FIG. 13 illustrates the biasing element 36 in schematic form, which can be or include rubber components, spring components, other biasing elements or any combination thereof.

With continued reference to FIGS. 1, 2, 11, and 12, the seismic isolator 10 can comprise an engineered elastomeric material 36. The elastomeric material 36 can comprise synthetic rubber, although other types of materials are also possible. The elastomeric material 36 can be used to fill in the remaining gaps or openings within the lower support element 32. The elastomeric material 36 can be used to help guide the elongate element 20 and return the elongate element 20 back toward or to an original resting position after the event of an earthquake.

The seismic isolator 10 can additionally comprise at least one retaining element 38 (FIG. 13). The retaining elements can be configured to retain and/or hold the elongate element 20. The retaining elements can comprise, for example, hardened elastomeric material. If desired, different possible retaining elements can be used. Various numbers of retaining elements are possible. During assembly of the seismic isolator 10, the elongate element 20 can be inserted for example down through the retaining elements.

Overall, the arrangement of the seismic isolator 10 can provide a support framework for allowing the elongate element 20 to shift horizontally during an earthquake in any direction within the horizontal plane permitted by the opening 26. This can be due at least in part to a gap "a" (see FIG. 1) that can exist between the bottom of the elongate element 20 (e.g., at the cap 22) and the bottom of the lower support element 32. This gap "a" can allow the elongate element 20 to remain decoupled from the lower support element 32, and thus allow the elongate element 20 to move within the opening 26 of second plate 24 during the event of an earthquake. The gap "a," and more specifically the fact that the elongate element 20 is decoupled from the lower support element 32, allows the first plate 12 and building support 14, which are attached to or integrally formed with the elongate element 20, to slide horizontally during an earthquake as well. The gap "a" can vary in size.

The arrangement of the seismic isolator 10 can also provide a framework for bringing the building support 14 back toward or to its original resting position. For example, one or more biasing elements, such as shock absorbers, in conjunction with a series of retaining elements 38 and/or elastomeric material 36 within the lower support element 32, can work together to ease the elongate element 20 back toward a central resting position within the lower support element 32, thus bringing the first plate 12 and building support member 14 back into a desired resting position.

During the event of an earthquake, ground seismic forces can be transmitted through the perforated rubber or elastomeric component 36 or the optional spring components 34 and elastomeric material 36 to the elongate element 20 and finally to the building or structure itself. The elongate element 20 and spring components 34/perforated rubber component 36 can facilitate dampening of the seismic forces. Lateral rigidity of the sliding isolator 10 can be controlled by the spring components 34, frictional forces, and the elongate element 20. In the event of wind forces and small earthquakes, frictional forces alone (e.g., between the plates 12 and 24) can sometimes be sufficient to control or limit the movement of the building and/or prevent movement of the building altogether. Delays and dampening of the movement of the structure can be controlled by the perforated rubber component 36 with silicon-filled perforations 37 or the optional spring components 34 and the opening 26. In some embodiments, seismic rotational forces (e.g., torsional, twisting of the ground caused by some earthquakes) can be controlled easily due to the nature of the design of the isolator 10 described above. For example, because of the opening 26, elongate element 20, and/or perforated elastomeric component 36, most if not all of the seismic forces can be absorbed and reduced by the isolator 10, thereby inhibiting or preventing damage to the building.

In some embodiments, the cap 22 can inhibit or prevent upward vertical movement of the first plate 12 during the event of an earthquake. For example, the cap 22 can have a diameter larger than that of the retaining elements 38, and the cap 22 can be positioned beneath the retaining elements 38 (see FIG. 1), such that the cap 22 inhibits the elongate element 20 from moving up vertically.

While one seismic isolator 10 is described and illustrated in FIGS. 1-12, in some embodiments, a building or other structure can incorporate a system of seismic isolators 10. For example the seismic isolators 10 can be located at and installed at particular locations underneath a building or other structure.

In some embodiments the seismic isolators 10 can be installed prior to the construction of a building. In some embodiments at least a portion of the seismic isolators can be installed as retrofit isolators 10 to an already existing building. For example, the support element 32 can be attached to the top of an existing foundation.

FIG. 13 illustrates a modification of the seismic isolator 10 in which the first plate 12 and the second plate 24 are essentially reversed in structure. In other words, the first plate 12 is larger in diameter than the second plate 24. The configuration of FIG. 13 can be well-suited for certain applications, such as bridges, for example and without limitation. A larger and longer top plate or first plate 12 could be utilized to fit other types of structures, including bridges. With such an arrangement, the second plate 24 supports the first plate 12 in multiple positions of the first plate 12 relative to the second plate 24. The low-friction layer 28 can be positioned on or applied to the bottom surface of the first plate 12 or the top surface of the second plate 24, or both. In other respects, the isolator 10 of FIG. 13 can be the same as or similar to the isolator 10 of FIGS. 1-12

(however, as described above, the biasing arrangement 36 can be of any suitable arrangement). In some embodiments, for example, the biasing arrangement 36 can comprise layers of radially-oriented compression springs.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those skilled in the art based upon this disclosure. It is also contemplated that various combinations or sub-combinations of the specific features and aspects of the embodiments can be made and still fall within the scope of the inventions.

It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A sliding seismic isolator, comprising:
a first plate rigidly attached to a building support;
at least one elongate element rigidly connected to and extending downward from the first plate;
a second plate;
a low-friction layer positioned between the first and second plates and configured to allow the first and second plates to move relative one another along a horizontal plane;
a lower support member attached to the second plate, wherein the second plate is located at an upper end of the lower support member;
at least one spring member positioned within the lower support member;
wherein the at least one elongate element extends from the first plate through the second plate and at least partially into the lower support member, and wherein the at least one spring member applies a biasing force to the at least one elongate element in a direction parallel to the horizontal plane.

2. The seismic isolator of claim 1, wherein the at least one spring member is positioned to extend in a radial direction relative to the at least one elongate element.

3. The seismic isolator of claim 1, wherein the at least one spring member comprises a plurality of spring members.

4. The seismic isolator of claim 3, wherein the plurality of spring members are arranged in multiple layers.

5. The seismic isolator of claim 1, wherein an end of the at least one elongate element within the lower support member is spaced above a bottom wall of the lower support member.

6. The seismic isolator of claim 1, wherein the at least one spring member comprises a layer of elastomeric or rubber material within the lower support member and acting on the at least one elongate element.

7. The seismic isolator of claim 1, further comprising at least one retaining element configured to couple the at least one spring member to the at least one elongate element.

8. The seismic isolator of claim 1, wherein the at least one elongate element comprises multiple elongate elements.

9. A sliding seismic isolator, comprising:
a first plate rigidly attached to a building support;
a second plate;
a rigid, cylindrical lower support that supports the second plate at an upper end of the lower support;
at least one elongate element rigidly coupled to and extending downward from the first plate into the lower support;
a low-friction layer positioned between the first and second plates and configured to allow the first and second plates to move relative one another along a horizontal plane when the first plate is supported on the second plate;
at least one spring member positioned within the lower support member and configured to resist movement of the at least one elongate element relative to the lower support, wherein the at least one spring member applies a biasing force to the at least one elongate element in a direction parallel to the horizontal plane.

10. The seismic isolator of claim 9, wherein the at least one spring member comprises a plurality of spring members.

11. The seismic isolator of claim 10, wherein the plurality of spring members are arranged in multiple layers.

12. The seismic isolator of claim 9, wherein the at least one spring member comprises a layer of elastomeric or rubber material.

13. The seismic isolator of claim 9, wherein an end of the at least one elongate element within the lower support member is spaced above a bottom wall of the lower support member.

14. The seismic isolator of claim 9, further comprising at least one retaining element configured to couple the at least one spring member to the at least one elongate element.

15. The seismic isolator of claim 9, wherein the at least one elongate element comprises multiple elongate elements.

16. A sliding seismic isolator, comprising:
a first plate rigidly attached to a building support;
a second plate;
a rigid, cylindrical lower support that supports the second plate at an upper end of the lower support;
at least one elongate element having a first end rigidly coupled to the lower support and extending in a cantilevered manner downward from the first plate into the lower support;
a low-friction layer positioned between the first and second plates and configured to allow the first and second plates to move relative one another along a horizontal plane when the first plate is supported on the second plate;
a biasing arrangement positioned within the lower support member and configured to resist movement of the at least one elongate element relative to the lower support by applying a biasing force to the at least one elongate element in a direction parallel to the horizontal plane.

17. The seismic isolator of claim 16, wherein the biasing arrangement comprises a plurality of spring members.

18. The seismic isolator of claim 17, wherein the plurality of spring members are arranged in multiple layers.

19. The seismic isolator of claim 16, wherein the biasing arrangement comprises a layer of elastomeric or rubber material.

20. The seismic isolator of claim 19, wherein the layer of elastomeric or rubber material comprises a plurality of isolated perforations, the biasing arrangement further comprises silicone within the plurality of perforations, wherein the silicone within each of the plurality of perforations extends from an upper surface to a lower surface of the layer of elastomeric or rubber material.

21. The seismic isolator of claim 16, wherein the at least one elongate element comprises multiple elongate elements.

22. The seismic isolator of claim 21, wherein the multiple elongate elements are configured to flex so as to absorb energy from seismic forces acting on the isolator.

23. The seismic isolator of claim 16, wherein the biasing arrangement is configured to return the at least one elongate element back toward or to an original resting position.

* * * * *